US006159023A

United States Patent [19]

Lai

[11] Patent Number: 6,159,023

[45] Date of Patent: Dec. 12, 2000

[54] ELECTRICAL CONNECTOR HAVING LATCHING MEMBERS FOR ENGAGING WITH A MATING CONNECTOR AND A CIRCUIT BOARD

[75] Inventor: Chin-Te Lai, Tao-Yuan, Taiwan

[73] Assignee: Hon Hai Precision Ind. Co., Ltd., Taipei Hsien, Taiwan

[21] Appl. No.: 09/315,881

[22] Filed: May 20, 1999

[30] Foreign Application Priority Data

Nov. 20, 1998 [TW] Taiwan ..... 87219268

[51] Int. Cl.[7] ..... H01R 12/00

[52] U.S. Cl. ..... 439/79; 439/607

[58] Field of Search ..... 439/607, 79, 80, 439/353, 83, 108, 610, 608, 609, 567

[56] References Cited

U.S. PATENT DOCUMENTS 5,575,663 11/1996 Broschard, III et al. ..... 439/79
5,586,008 12/1996 Kozel et al. ..... 361/743
5,603,639 2/1997 Lai et al. ..... 439/607
5,823,799 10/1998 Tor et al. ..... 439/79

*Primary Examiner*—Brian Sircus
*Assistant Examiner*—Son V. Nguyen
*Attorney, Agent, or Firm*—Wei Te Chung

[57] ABSTRACT

An electrical connector includes an insulative housing having a central section defining a plurality of passageways each receiving a contact element therein and two end blocks. A latching member made of metal by means of stamping and pressing has a U-shaped structure fit over each of the end blocks. The latching member has a latching arm extending from the U-shaped structure for engaging with a mating connector. The latching member also has a second arm extending from the U-shaped structure for engaging with and retaining a circuit board. The second arm has a convex portion confronting a face of the end block and defining a gap therebetween for receiving the circuit board whereby the convex portion engages with a surface thereof. Alternatively, the second arm may extend through and engage with a hole defined in the circuit board for retaining the circuit board in the connector.

3 Claims, 10 Drawing Sheets

ELECTRICAL CONNECTOR HAVING LATCHING MEMBERS FOR ENGAGING WITH A MATING CONNECTOR AND A CIRCUIT BOARD

BACKGROUND OF THE INVENTION

1. Field of the Invention

The present invention generally relates to an electrical connector.

2. The Prior Art

Electrical connectors of the type disclosed in U.S. Pat. No. 5,178,557 are well known in the electronics field. As shown in FIG. 8 of the attached drawings, the electrical connector of the '557 patent generally comprises an insulative housing 71 having a base section 72 and two end blocks 74. Each end block 74 defines a bore 75 for receiving a locking block 73. The locking block 73 has a hook 76 extending beyond a front face of the housing 71 for engaging with a mating connector (not shown). The locking block 73 defines an inner-threaded hole 70 for receiving and engaging with a bolt thereby securing the connector to a circuit board (not shown). The locking block 73 is made of plastic and the hook 76 is integrated with the locking block 73 whereby the hook 76 has a poor mechanical strength and may be easily broken. Furthermore, the connector is secured to the circuit board by means of bolts whereby the assembly thereof is time inefficient.

U.S. Pat. No. 5,603,639 discloses an electrical connector which, as shown in FIG. 9, comprises an insulative housing 100 having two end blocks 101. A U-shaped member 102 made of a metal plate by means of stamping and pressing is sideways fit over each end block 101 and fixed thereon. The U-shaped member 102 has an arm 840 on which barbs 820 are formed for engaging with a mating connector. The metal member 102 of the '639 patent's connector overcomes the mechanical deficiency problem of the '557 patent. Nevertheless, the '639 connector is still secured to a circuit board by means of bolts (not shown) thereby complicating assembly of the connector to the circuit board.

It is thus desirable to provide an electrical connector which is readily mounted to a circuit board.

SUMMARY OF THE INVENTION

Accordingly, an object of the present invention is to provide an electrical connector which can be readily mounted to a circuit board.

Another object of the present invention is to provide an electrical connector comprising a latch member made from a metal plate having a first resilient arm for engaging with a mating connector and a second resilient arm for engaging with and applying a spring force to a circuit board to retain the circuit board and the connector together.

To achieve the above objects, an electrical connector in accordance with the present invention comprises an insulative housing having a central section defining a plurality of passageways each receiving a contact element therein and two end blocks. A latching member made of metal by means of stamping and pressing has a U-shaped structure fit over each of the end blocks. The latching member has a latching arm extending from the U-shaped structure for engaging with a mating connector. The latching member also has a second arm extending from the U-shaped structure for engaging with and retaining a circuit board. The second arm has a convex portion confronting a face of the end block and defining a gap therebetween for receiving the circuit board whereby the convex portion engages with a surface thereof. Alternatively, the second arm may extend through and engage with a hole defined in the circuit board for retaining the circuit board in the connector.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
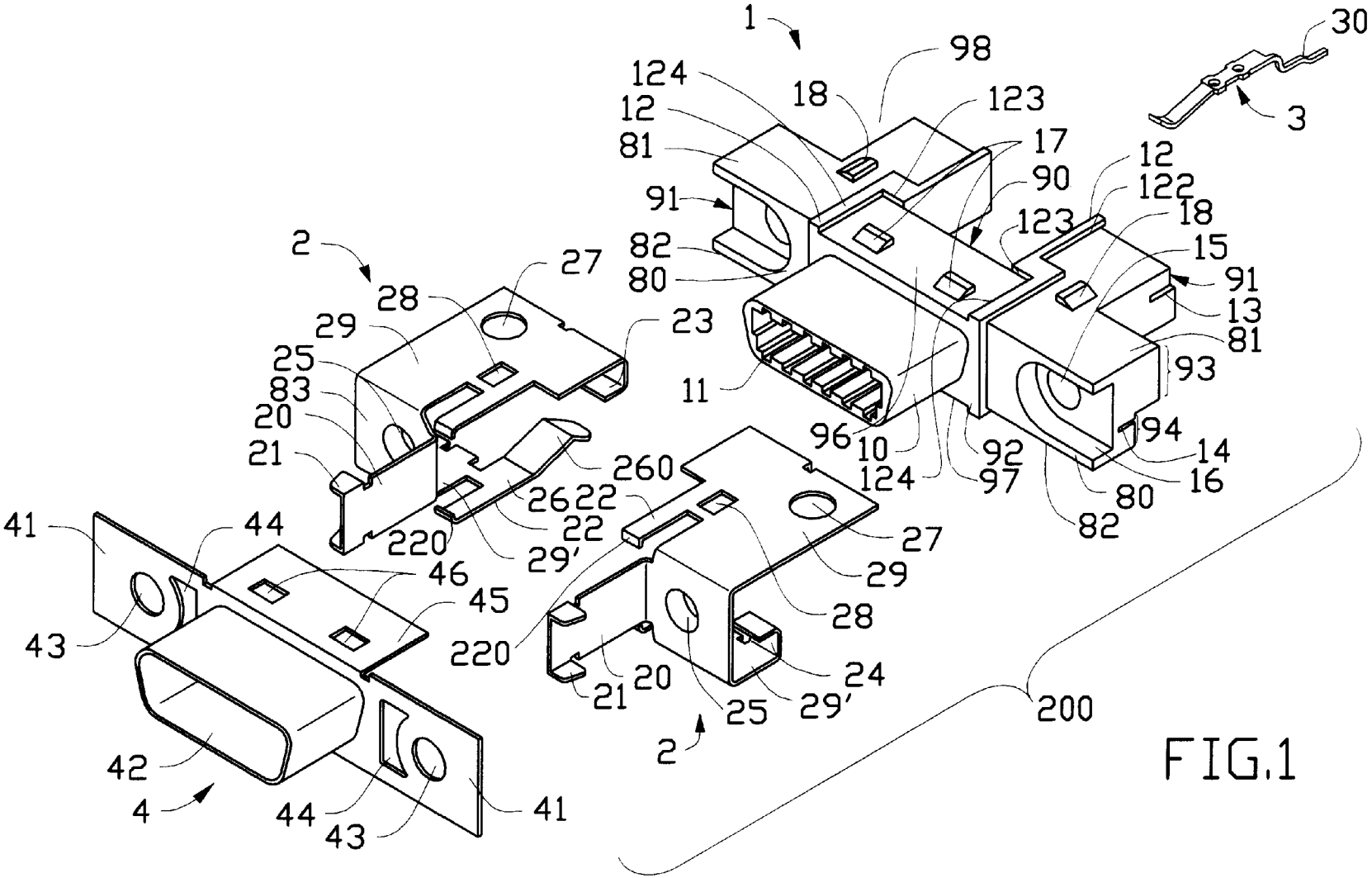
FIG. 1 is an exploded view of an electrical connector in accordance with a first embodiment of the present invention.
Figure 2:
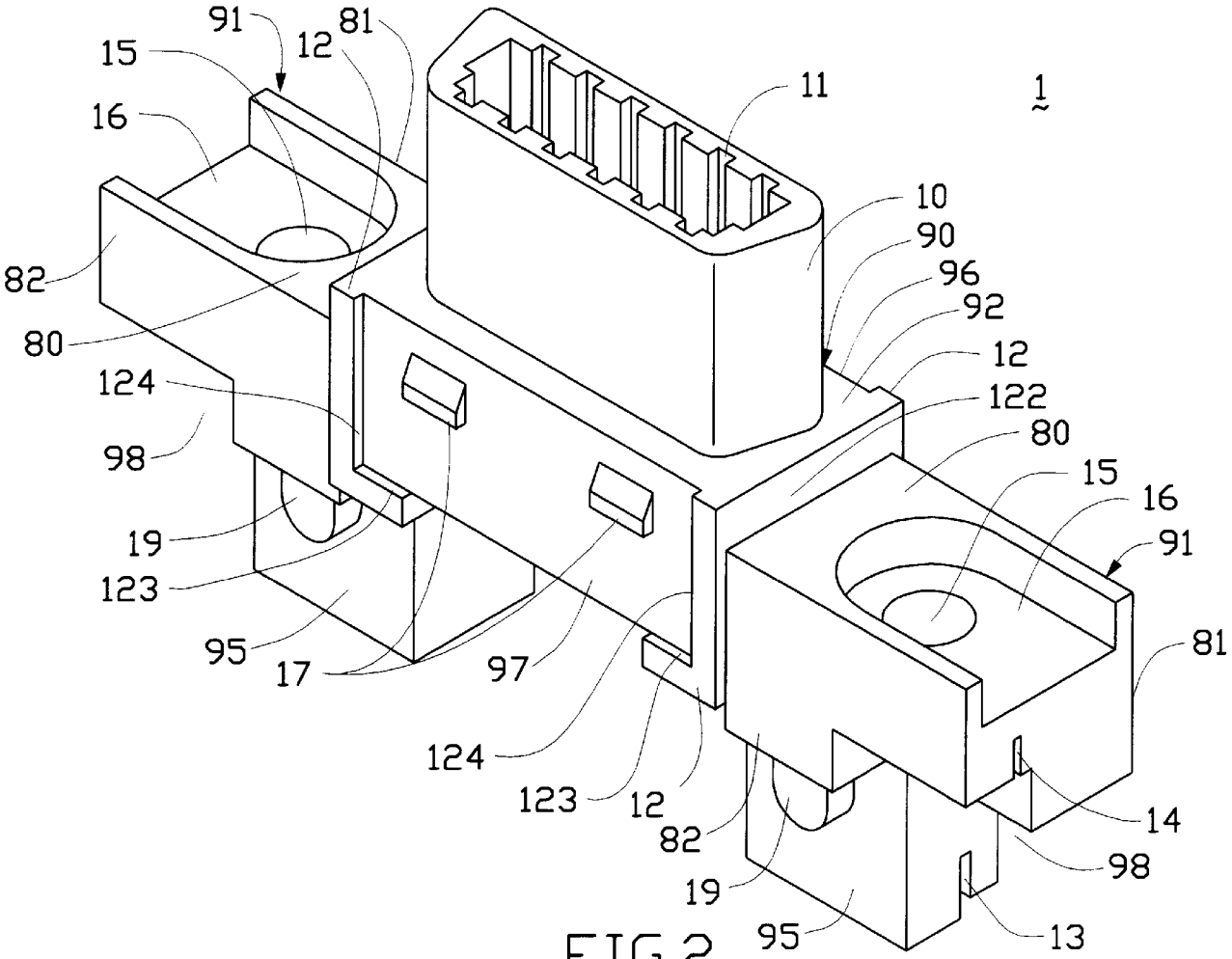
FIG. 2 is a perspective view of an insulative housing of the electrical connector of the present invention.
Figure 3:
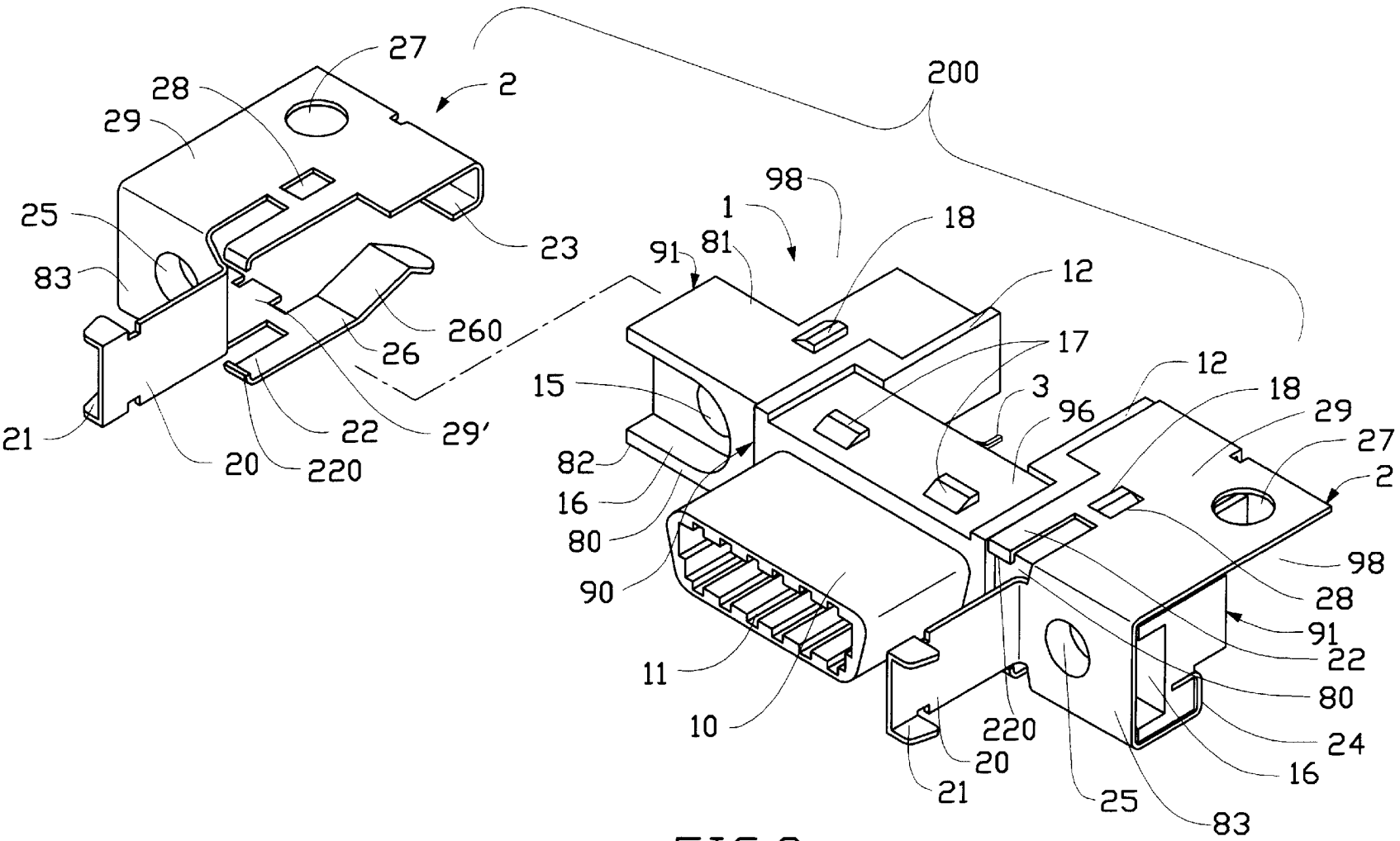
FIG. 3 is a perspective view of the housing and a pair of latching members of the electrical connector of the present invention showing one latching member mounted to the housing.
Figure 5:
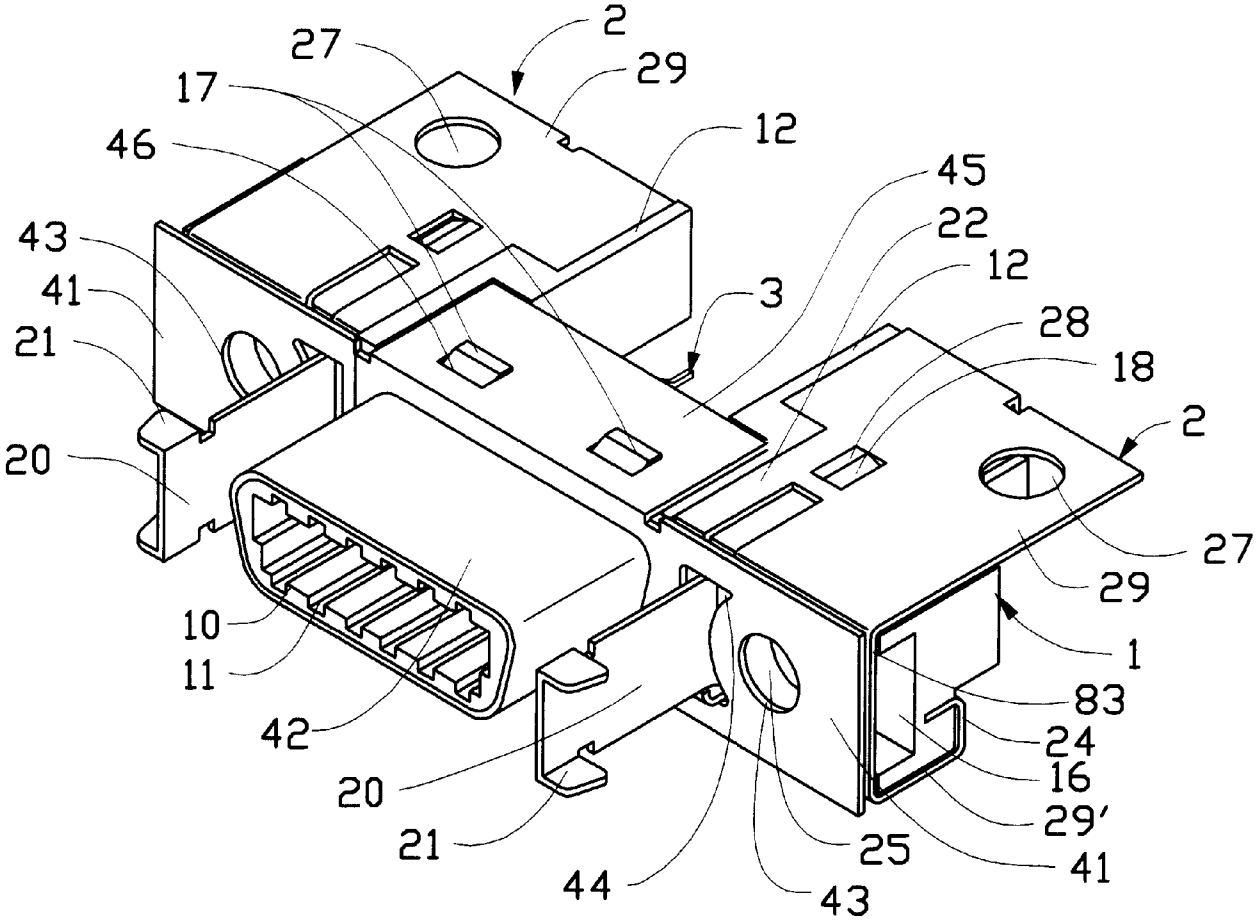
FIG. 5 is an assembled view of FIG. 1.

Referring to the drawings and in particular to FIGS. 1 and 2, an electrical connector 200 in accordance with the present invention comprises an insulative housing 1, two latching members 2, a plurality of contact elements 3 and a shielding member 4. The insulative housing 1 comprises an elongate parallelepiped structure having a D-shaped coupling section 10 projecting from a front face 92 thereof. A plurality of passageways 11 are defined in the coupling section 10 and extend through the housing 1 for each receiving one of the contact elements 3 therein. The contact element 3 has a tail section 30 extending beyond a rear face (not labeled) of the housing 1 as shown in FIGS. 3 and 5. It should be noted that for simplicity, only one contact element 3 is shown in the drawings.

The housing 1 has two walls 12 dividing the housing 1 into a central section 90 located between the walls 12 and two end sections 91. The coupling section 10 is formed on the front face 92 of the central section 90. The central section 90 has a top face 96 and an opposite bottom face 97 each having wedge-shaped barbs 17 formed thereon. Each end section 91 has a front face 80 having a U-shaped recess 16 defined therein. A bore 15 is defined in the U-shaped recess 16 through the end section 91. The end section 91 has a top face 81 and an opposite bottom face 82. A wedge-shaped barb 18 is formed on the top face 81 of each end section 91. The end section 91 has a stepped rear face forming a first portion 93 and a second portion 94 respectively defining a first slit 13 and a second slit 14 therein. The first portion 93 has a bottom face 95 on which a rib 19 is formed for properly positioning the connector 200 on a circuit board 99.

A recessed zone (not labeled) is defined on both the top face 96 and the bottom face 97 of the central section 90 of the housing 1 between the walls 12. Each wall 12 has a guiding face 124 opposing each other for guidingly receiving a top or bottom panel 45 of the shielding member 4 into the recessed zone. The walls 12 also have a stop face 123 for properly positioning the top or bottom panel 45 of the shielding member 4 with respect to the housing 1.

Each wall 12 also forms a stop face 122 associated with each of the end sections 91 for engaging with and positioning the corresponding latching member 2 with respect to the housing 1.

Also referring to FIG. 3, each latching member 2 is associated with one of the end sections 91 of the housing 1. The latching member 2 defines a U-shaped configuration having a bottom forming a base section 83 and two side limbs respectively forming a first engaging section 29 and a second engaging section 29' extending from the base section 83.

Figure 4:
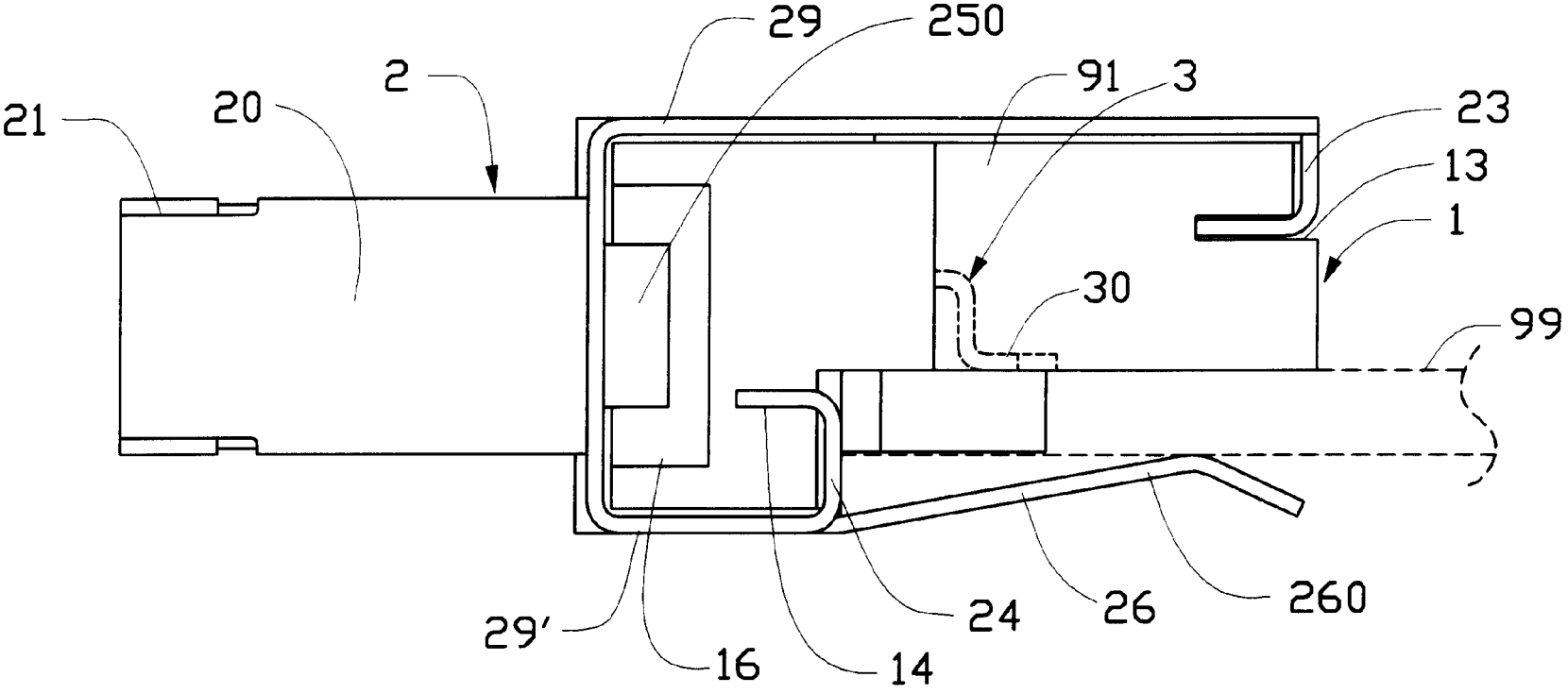
FIG. 4 is a side elevational view of the electrical connector of the present invention.

A latching arm 20 extends from the base section 83 opposite the engaging sections 29, 29'. The latching a rm 20 has a free end on which retaining barbs 21 are formed for engaging with and retaining a mating connector (not shown). The base section 83 of the latching member 2 defines a central hole 25 which may be formed by means of stamping thereby forming a cylindrical extension 250 (FIG. 4). The hole 25 is aligned with the bore 15 of the corresponding end section 91 of the housing 1 and the extension 250 is received in the recess 16.

Each latching member 2 also has resilient arms 22 extending from the engaging sections 29, 29'. Each latching member 2 has a bent free end 220 engageable with the front face 80 of the corresponding end section 91 of the housing 1 for retaining the latching member 2 thereon.

The first engaging section 29 has a U-shaped free end 23 for engaging with the first slit 13 of the end section 91 of the housing 1. The second engaging section 29' has a U-shaped free end 24 for engaging with the second slit 14 of the end section 91 of the housing 1. Thus, the latching member 2 is securely retained on the end section 91 of the housing 1.

The latching member 2 also comprises a resilient arm 26 extending from the engaging section 29'. The resilient arm 26 has a free end on which a convex surface 260 is formed. The convex surface 260 of the resilient arm 26 faces the bottom face 95 of the first portion 93 of the stepped rear face of the end section 91 of the housing 1 for receiving the circuit board 99 therebetween with the tail section 30 of the contact element 3 engaging with the circuit board 99 (FIG. 4). In this respect, the convex surface 260 of the resilient arm 26 may be formed corresponding to the thickness of the circuit board 99 in order to securely engage therewith. Thus, the resilient arm 26 serves as a board lock of the connector 200.

The first engaging section 29 defines an opening 28 therein for engaging with the barb 18 of the end section 91 of the housing 1 thereby securely retaining the latching member 2 to the housing 1. The first engaging section 29 also defines an optional bolt hole 27 therein through which a bolt (not shown) may extend to secure the connector 200 to the circuit board 99. The first portion 93 of the end section 91 may have a cutout 98 or simply a bore through which the bolt may extend to engage with the circuit board 99.

Referring to FIGS. 1 and 5, the shielding member 4 comprises a D-shaped tubular section 42 fit over the D-shaped coupling section 10 of the housing 1 and two side panels 41 which overlap the base sections 83 of the U-shaped structures of the latching members 2. Each side panel 41 defines a slot 44 therein through which the latching arm 20 of the corresponding latching member 2 extends. The side panel 41 also defines a bolt hole 43 in alignment with the hole 25 of the base section 83 of the corresponding latch 2 for receiving a fastener (not shown) to secure the shielding member 4 to the housing 1.

The top and bottom panels 45 of the shielding member 4 define openings 46 therein for being engaged by barbs 17 of the housing 1 to secure the shielding member 4 on the housing 1.

With reference to FIG. 3, the latching member 2 is mounted to the end section 91 of the housing 1 by fitting the U-shaped structure of the latching member 2 over the end section 91 in the lengthwise direction of the housing 1 with the first and second engaging sections 29, 29' respectively sliding sideways over the top and bottom faces 81, 82 of the end section 91 and the ends 23, 24 of the engaging sections 29, 29' inserted into the corresponding slits 13, 14 of the end section 91. The sliding motion of the latch 2 with respect to the end section 91 of the housing 1 is stopped by the stop face 122 of the corresponding wall 12. The barb 18 engages with the opening 28 of the first engaging section 29 thereby retaining the latch 2 on the end section 91 of the housing 1.

Figure 10:
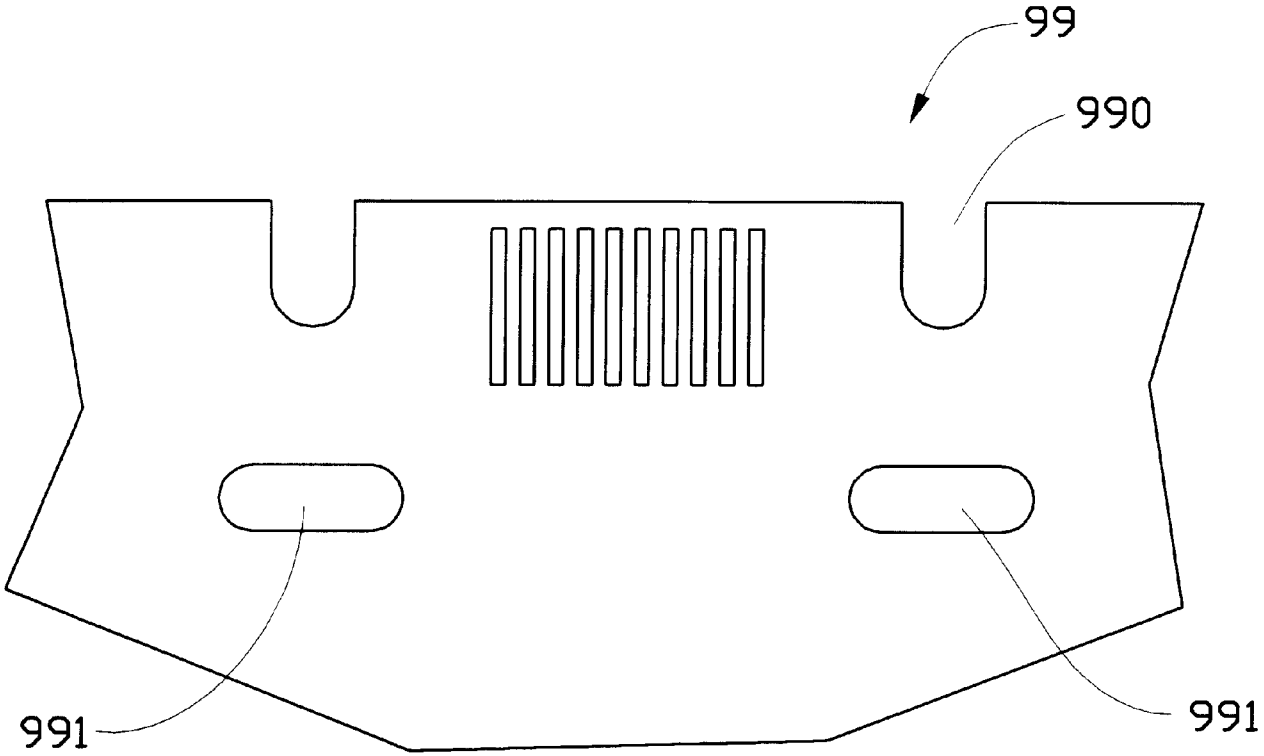
FIG. 10 is a plan view of a circuit board to which the electrical connector of the present invention may be mounted.

The circuit board 99 defines notches 990 (FIG. 10) fitting over the ribs 19 formed on the first portions 93. The circuit board 99, once fit into the connector 200, is secured in position by being engaged by the convex surfaces 260 of the resilient arms 26.

Referring to FIG. 5, after the latching members 2 are mounted to the end sections 91 of the housing 1, the shielding member 4 is attached to the front face 92 of the central section 90 of the housing 1 by fitting the tubular section 42 over the coupling section 10 of the housing 1 with the side panels 41 of the shielding member 4 overlapping the base sections 83 of the latching members 2. The top and bottom panels 45 of the shielding member 4 slide over the top and bottom faces 96, 97 of the central section 90 of the housing 1 and the openings 46 thereof engage with the barbs 17 thereby securing the shielding member 4 on the housing 1.

Figure 6:
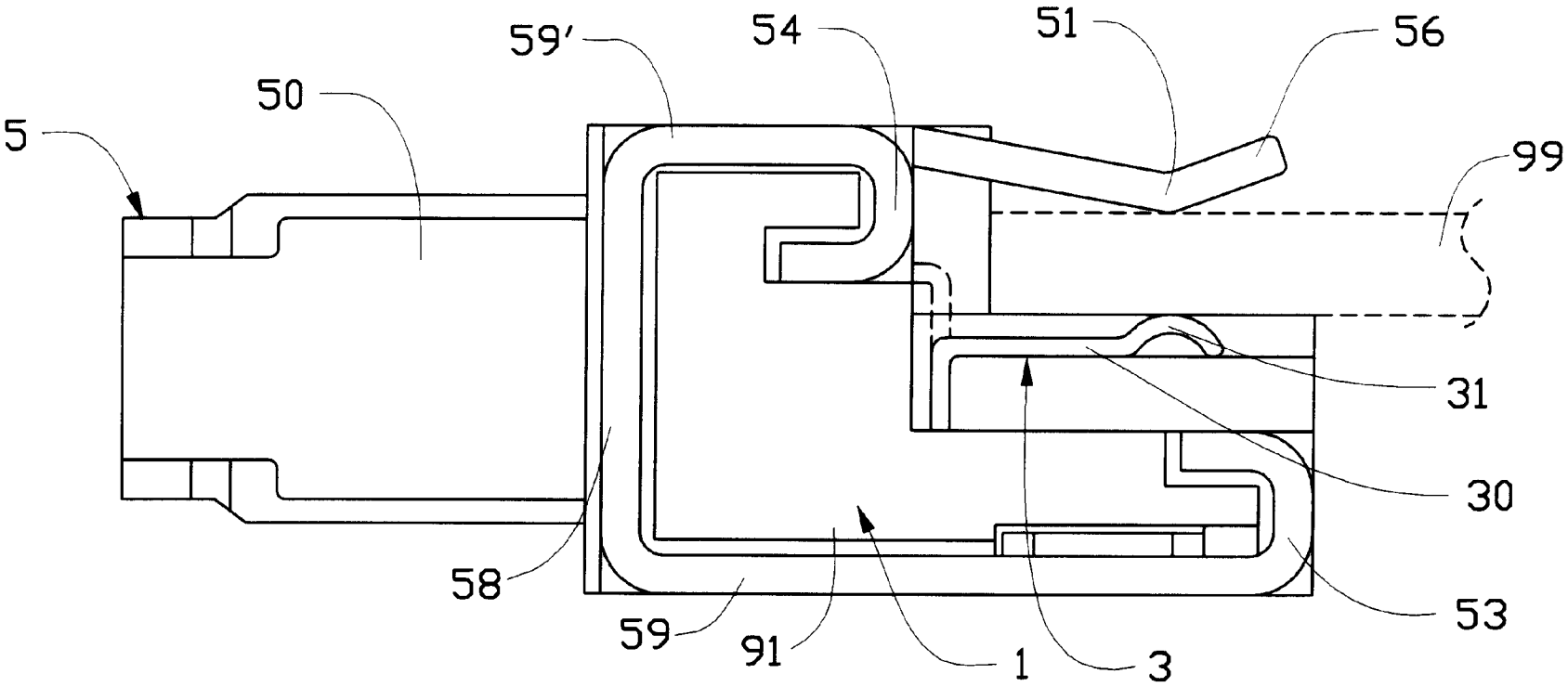
FIG. 6 is a side elevational view of an electrical connector constructed in accordance with a second embodiment of the present invention.

With reference to FIG. 6 wherein a second embodiment of the present invention is shown, the latching member, which is now designated by reference numeral 5, comprises a base 58 and first and second engaging sections 59, 59'. A latching arm 50 extends from the base section 58 opposite the engaging sections 59, 59'. The first engaging section 59 has a U-shaped free end 53 engaging with the first slit 13 of the corresponding end section 91 of the housing 1, while the second engaging section 59' has a U-shaped free end 54 engaging with the second slit 14 of the end section 91. The second engaging section 59' also has a resilient arm 56 forming a convex surface 51 engaging with and retaining the circuit board 99 in the housing 1. To provide a secure engagement between the housing 1 and the circuit board 99, the tail section 30 of the contact element 3 forms a convex surface 31 substantially corresponding to the convex surface 51 of the resilient arm 56 for securing the circuit board 99 therebetween. In this respect, the resilient arm 56 also functions as a board lock.

Figure 7:
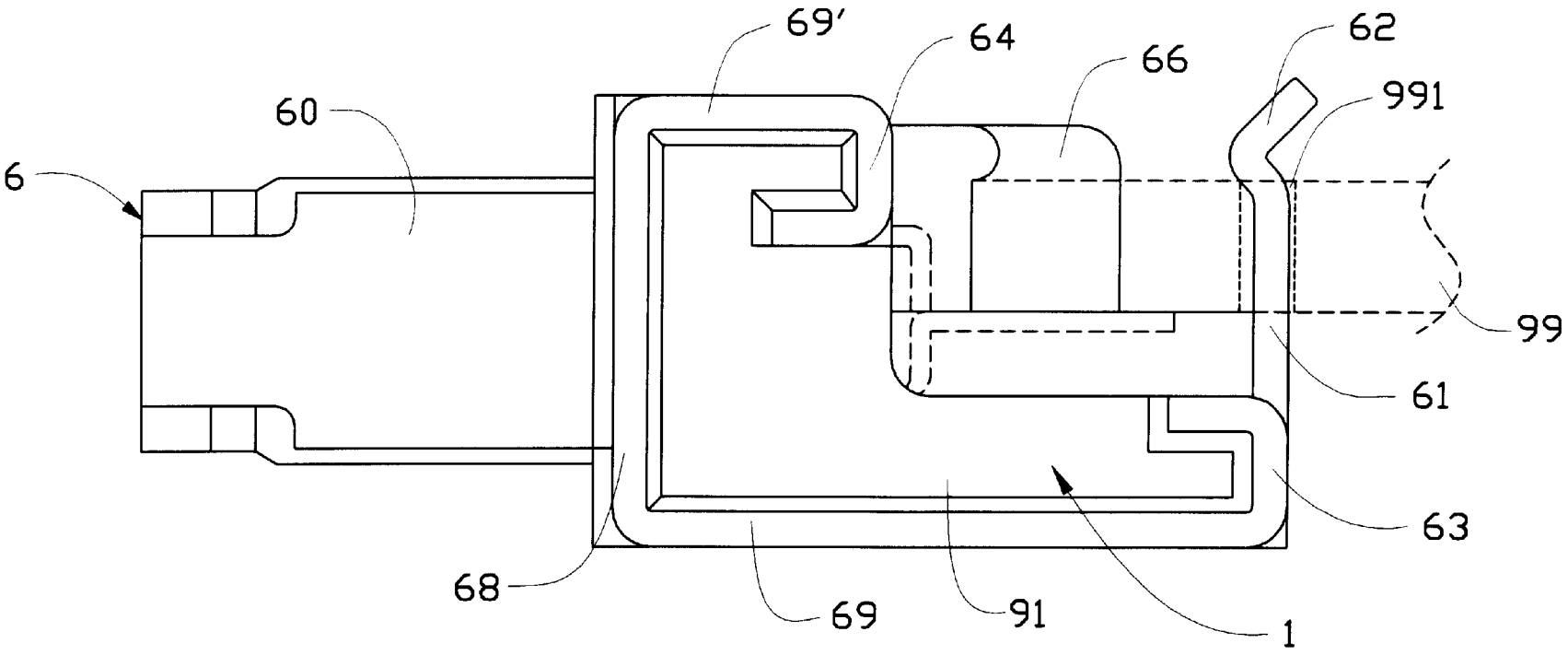
FIG. 7 is a side elevational view of an electrical connector constructed in accordance with a third embodiment of the present invention.
Figure 8:
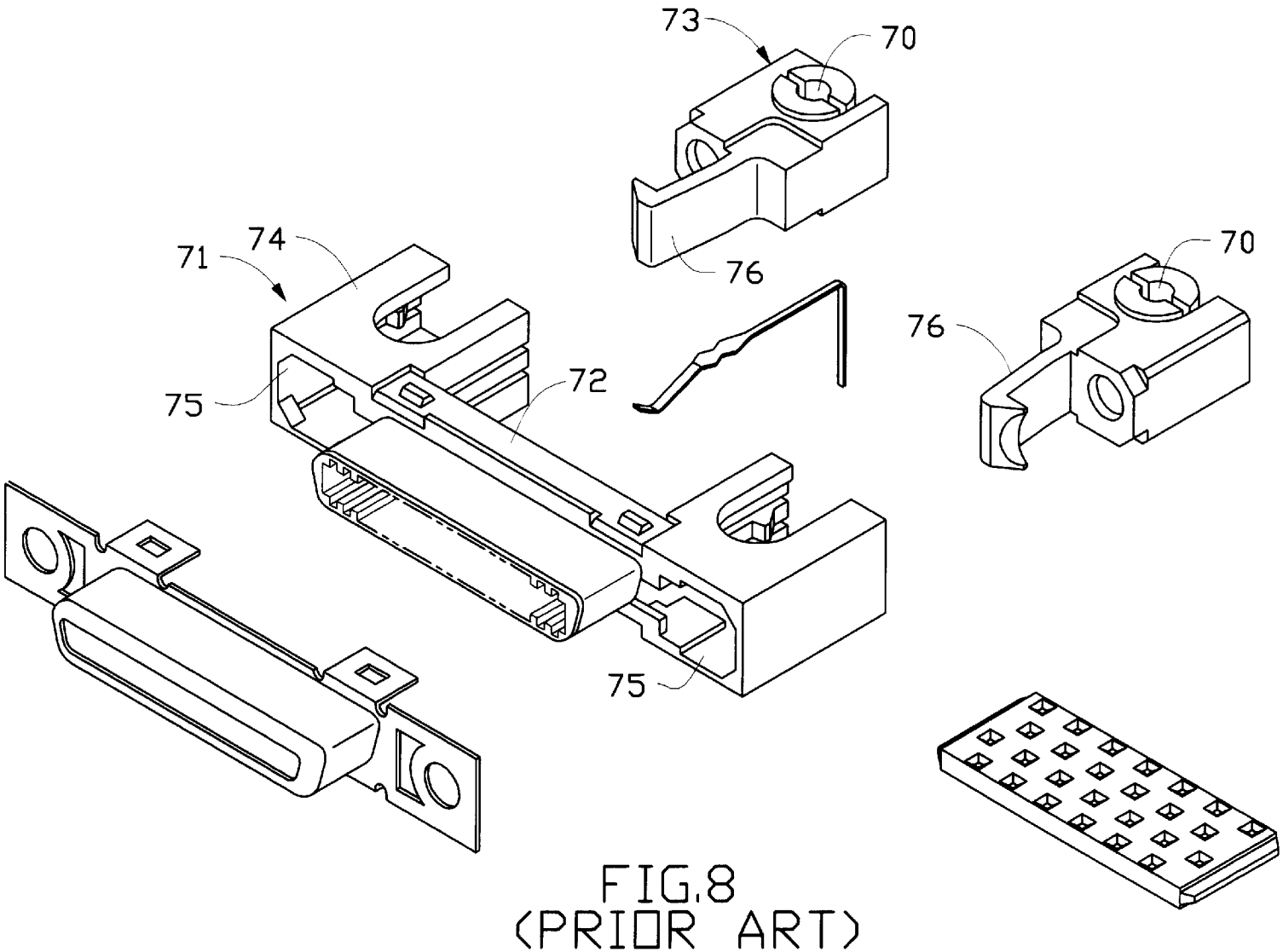
FIG.8 (PRIOR ART)
FIG. 8 is an exploded view of a conventional connector.
Figure 9:
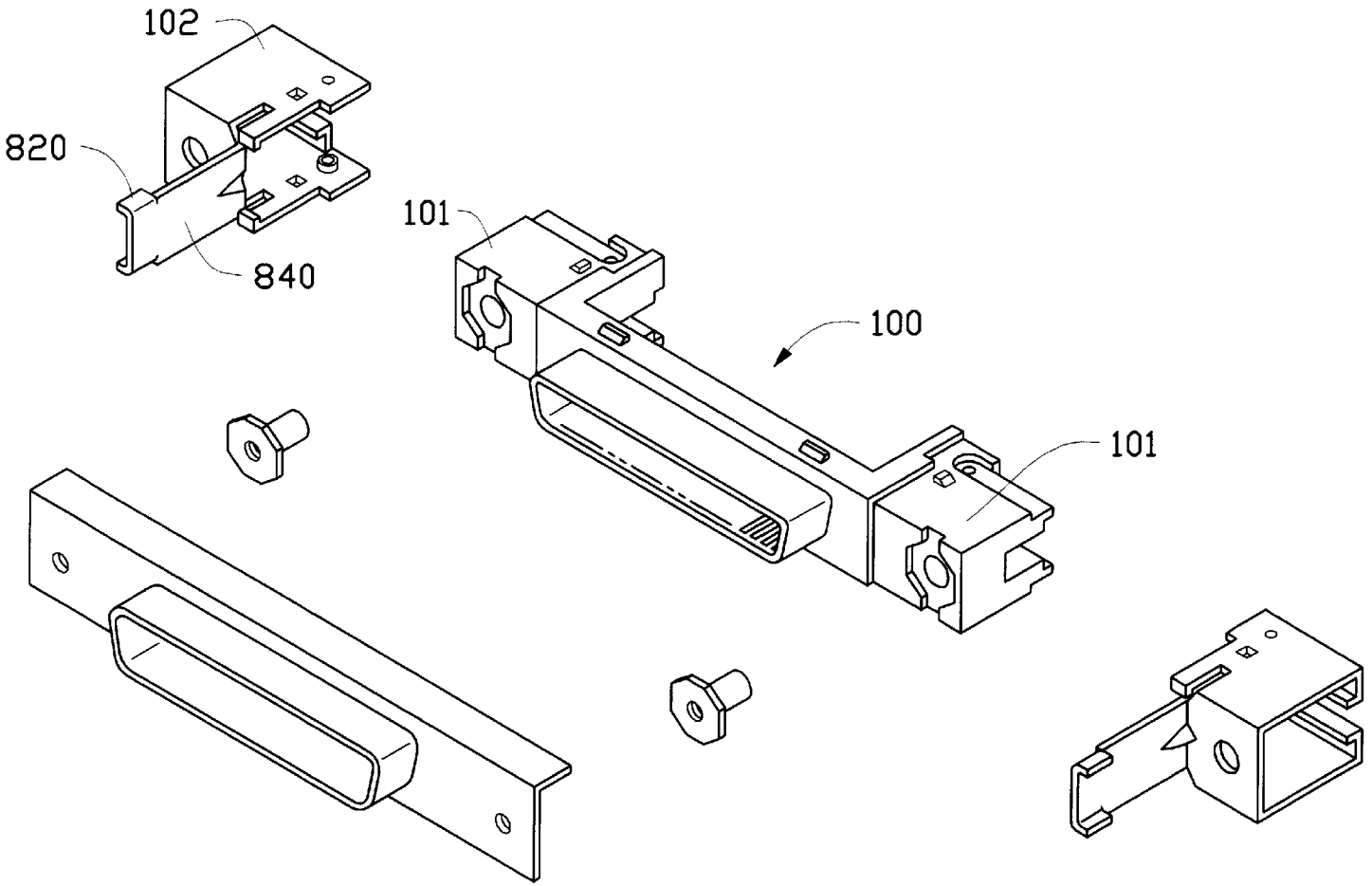
FIG.9 (PRIOR ART)
FIG. 9 is an exploded view of another conventional connector.

Referring to FIG. 7 wherein a third embodiment of the present invention is shown, the latching member, which is now designated by reference numeral 6, comprises a base section 68 from which a first engaging section 69 and a second engaging section 69' extend. Each engaging section 69, 69' has a U-shaped end 63, 64 engaging with the first and second slits 13, 14 of the corresponding end section 91 of the housing 1. A latching arm 60 extends from the base section 68 opposite the engaging sections 69, 69'. The second engaging section 69' has a retaining member 66 for engaging with and retaining the circuit board 99. The first engaging member 69 has a perpendicular arm 61, serving as a board lock, extending through a hole 991 defined in the circuit board 99 (FIG. 10) for securely retaining the circuit board 99. Preferably, the arm 61 has a convex free end 62 for retaining the circuit board 99.

In view of the structure of the connector 200 described above, it is evident that the latching member 2 may be made from a metal plate by means of stamping and pressing thereby facilitating the manufacture and assembly thereof. The provision of a board lock on a latching member allows the two parts of the connector to be manufactured simultaneously in a simple forming operation. Furthermore, the board lock formed on the latching member allows the connector to be easily mounted to circuit boards of different thickness.

One feature of the invention is to provide the connector with retention means with regard to the board wherein one retention force is exerted by the contact elements and the other opposite retention force is generated by the metal clip, i.e., the latching member 2, so that the board may be retainably sandwiched between the metal clip and the contact elements.

Although the present invention has been described with reference to preferred embodiments, it is apparent to those skilled in the art that a variety of modifications and changes may be made without departing from the scope of the present invention which is intended to be defined by the appended claims.

What is claimed is:

1. An electrical connector mounted to a circuit board, comprising an insulative housing having a central section defining a plurality of passageways therein each receiving contact element and two end blocks and two latching members each having a structure fit over a corresponding end block and a latching arm extending from a bottom wall of the structure for engaging with a mating connector, the improvements comprising a resilient arm extending from the structure and facing a face of the end block to define a gap therebetween receiving the circuit board therein, the resilient arm exerting an urging force to a first surface of the circuit board to securely retain the circuit board in the connector, wherein the structure is U-shaped, the resilient arm forms a convex surface at a free end thereof engaging with the first surface of the circuit board, and the contacts elements have tail ends extend beyond the connector engaging with a second surface of the circuit board, at least one of the contact elements being formed with a convex portion corresponding to the convex surface of the resilient arm securely retaining the circuit board there between.

2. An electrical connector mounted to a circuit board, comprising an insulative housing having a central section defining a plurality of passageways each receiving a contact element therein and two end blocks and two latching members each having a structure fit over a corresponding end block and a latching arm extending from a bottom wall of the structure for engaging with a mating connector, each latching arm comprising a resilient arm extending from the structure and engaging with a hole defined in the circuit board for retaining the circuit board in the connector, wherein the structure is U-shaped and the resilient arm forms a convex surface at a free end thereof to securely retain the circuit board in the connector.

3. An electrical connector mounted to a circuit board, comprising an insulative housing having a central section with a plurality of contact elements therein, two end blocks positioned at two opposite ends of the housing, a metal clip being attached to each of said end blocks with a rearwardly extending spring arm thereof, wherein said circuit board is retainably attached to the connector by two opposite forces, one force being generated by some of the contact elements, which have tail sections disposed by a first surface of the circuit board, and imposed on said first surface of the circuit board, and the other force bean generated by the spring arm of the metal clip, which is disposed by a second surface, and imposed upon said second surface of the circuit board opposite to said first surface, wherein said clip is U-shaped and the spring arm forms a convex surface at a free end thereof to securely retain the circuit board in the connector.

* * * * *